United States Patent [19]

Watanabe et al.

[11] Patent Number: 4,535,981

[45] Date of Patent: Aug. 20, 1985

[54] PAPER SHEET FEEDING ARRANGEMENT

[75] Inventors: Yutaka Watanabe, Nakano; Fumio Fukumoto, Sagamihara, both of Japan

[73] Assignee: Minolta Camera Kabushiki Kaisha, Osaka, Japan

[21] Appl. No.: 549,815

[22] Filed: Nov. 8, 1983

[30] Foreign Application Priority Data

Nov. 16, 1982 [JP] Japan ..... 57-201383

[51] Int. Cl.[3] ..... B65H 3/52

[52] U.S. Cl. ..... 271/121; 271/164; 271/167; 271/124

[58] Field of Search ..... 271/121, 122, 164, 167, 271/162, 37, 117, 124; 355/14 SH, 3 SH

[56] References Cited

U.S. PATENT DOCUMENTS 3,563,535 2/1971 Vitu et al. ..... 271/164

4,089,516 5/1978 Colgazier et al. ..... 271/121

4,280,692 7/1981 Hutchinson et al. ..... 271/164

4,372,676 2/1983 Miyata et al. ..... 355/14 C

FOREIGN PATENT DOCUMENTS 56-65739 6/1981 Japan .

*Primary Examiner*—Bruce H. Stoner, Jr.

*Assistant Examiner*—James E. Barlow

*Attorney, Agent, or Firm*—Wenderoth, Lind & Ponack

[57] ABSTRACT

The disclosure is directed to an improved paper sheet feeding arrangement for use in a copying apparatus or the like, which is capable of positively preventing paper sheets from wrinkling, bending, etc. during withdrawal of a paper sheet cassette by returning the paper sheet having a projecting leading edge, back into the paper sheet cassette in association with a multi-sheet feeding prevention mechanism when the cassette is released from a paper feeding section.

6 Claims, 6 Drawing Figures

PAPER SHEET FEEDING ARRANGEMENT

BACKGROUND OF THE INVENTION

The present invention generally relates to a paper feeding arrangement and more particularly, to a paper sheet feeding arrangement for use in an electrophotographic copying apparatus and the like.

Generally, for the paper sheet feeding arrangement of the above described type, there has been employed for the actual application, an arrangement in which copy paper sheets in a stack accommodated in a paper sheet cassette detachably mounted on a paper feeding section are fed, one sheet by one sheet, from the uppermost layer of the stack based on rotation of a paper feeding roller. In the paper sheet feeding arrangement of the above described type, there has conventionally been provided a multi-sheet feeding prevention mechanism of a type employing a separating claw or having a paper sheet separating stand or paper sheet separating roller provided to confront the lower peripheral portion of the feeding roller so as to displace or separate copy paper sheets for avoiding such an inconvenience that two or three sheets of paper are fed simultaneously. In the multi-sheet feeding prevention mechanism of the above described kind, the type adopting the paper sheet separating stand or paper sheet separating roller is superior to the type employing the separating claw in the accurate functioning and compact size of the mechanism, etc.

Incidentally, in the type employing the paper sheet separating stand or paper sheet separating roller as referred to above, the leading edge of a paper sheet to be subsequently fed undesirably extends or projects up to the portion of the separating stand or separating roller from the end face of the cassette in a paper feeding direction at each feeding of one paper sheet, and therefore, there are such disadvantages that the projecting portion of the paper sheet is brought into contact with surrounding side frames, outer panel members, etc. during withdrawal of the cassette from the paper feeding section so as to be undesirably wrinkled, and that, even after withdrawal of the cassette, such projecting portion accidentally contacts hands of an operator, etc. resulting in formation of wrinkles or bending thereat.

On the other hand, for attaching or detaching the cassette with respect to the paper feeding section, there are available two directions, i.e. one direction which is in the same direction as the feeding direction of the paper sheets, and the other direction which intersects at right angles with the feeding direction of the paper sheets, and generally, employment of the direction intersecting at right angles with the paper sheet feeding direction is more advantageous from the viewpoint of operability, available spaces, etc. However, if the above cassette attaching or detaching direction intersecting at right angles with the paper sheet feeding direction is adopted, there is an increased possibility that the projecting portion of the paper sheet described earlier is brought into contact with the surrounding side frames, outer panel members, etc. in the course of withdrawal of the cassette from the paper feeding section, with the tendency toward formation of wrinkles becoming more conspicuous as compared with that in the cassette attaching or detaching direction which is in the same direction as the paper sheet feeding direction.

SUMMARY OF THE INVENTION

Accordingly, an essential object of the present invention is to provide an improved paper sheet feeding arrangement for use in a copying apparatus or the like, which is capable of positively preventing paper sheets from wrinkling, bending, etc. during withdrawal of a paper sheet cassette by pushing the paper sheet having a projecting leading edge, back into the paper sheet cassette in association with a multi-sheet feeding prevention mechanism when the cassette is released from a paper feeding section.

Another important object of the present invention is to provide a paper sheet feeding arrangement of the above described type which is simple in construction and accurate in functioning at high reliability, and can be readily incorporated into various copying apparatuses or the like at low cost.

In accomplishing these and other objects, according to one preferred embodiment of the present invention, there is provided a paper sheet feeding arrangement for feeding paper sheets, one sheet by one sheet, from a stack of the paper sheets, which includes a paper feeding roller contacting the paper sheet and driven for rotation in a paper sheet feeding direction, and a paper sheet separating member held in pressure contact by said paper feeding roller for preventing the paper sheet fed by said paper feeding roller from advancing so as to feed only the paper sheet contacting the paper feeding roller by passing between said paper feeding roller and said paper sheet separating member, and is characterized in that there are further provided;

(a) means for holding the stack of paper sheets movably in a direction approximately at right angles with respect to the feeding direction of the paper sheets between a first position where the stack of paper sheets confronts said paper feeding roller and a second position where the stack of paper sheets is spaced from said paper feeding roller, (b) a pushing member pivotally provided so as to be capable of pushing back the paper sheet located between the paper feeding roller and the paper sheet separating member towards the stack of paper sheets through pivotal movement thereof, (c) a first biasing means for urging said pushing member to be pivoted in a direction of the pushing back, (d) a stopper means for stopping said pushing member at a stand-by position for the pushing back against the urging force of said first-biasing means, (e) a second biasing means for urging the holding means in a direction towards said second position when said holding means is in said first position, (f) a locking means for locking said holding means at said first position against the urging force of said second biasing means, (g) a lock releasing means for releasing said locking means from the locked state, and (h) an associating means which is associated with said lock releasing means so as to release said paper sheet separating member from the pressure contact with respect to said paper sheet feeding roller, and also to release said stopper means from stopping of said pushing member. The associating means functions to associate said paper sheet separating member, stopper means and locking means with each other so as to effect releasing in such order as the releasing of the pressure contact of said paper sheet separating member, releasing of stopping of the pushing member by said stopper means, and releasing of locking of said holding means by said locking means following the functioning of said lock releasing means.

By the constructions according to the present invention as described above, an improved paper sheet feeding arrangement has been advantageously presented, with substantial elimination of disadvantages inherent in the conventional arrangements of this kind.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
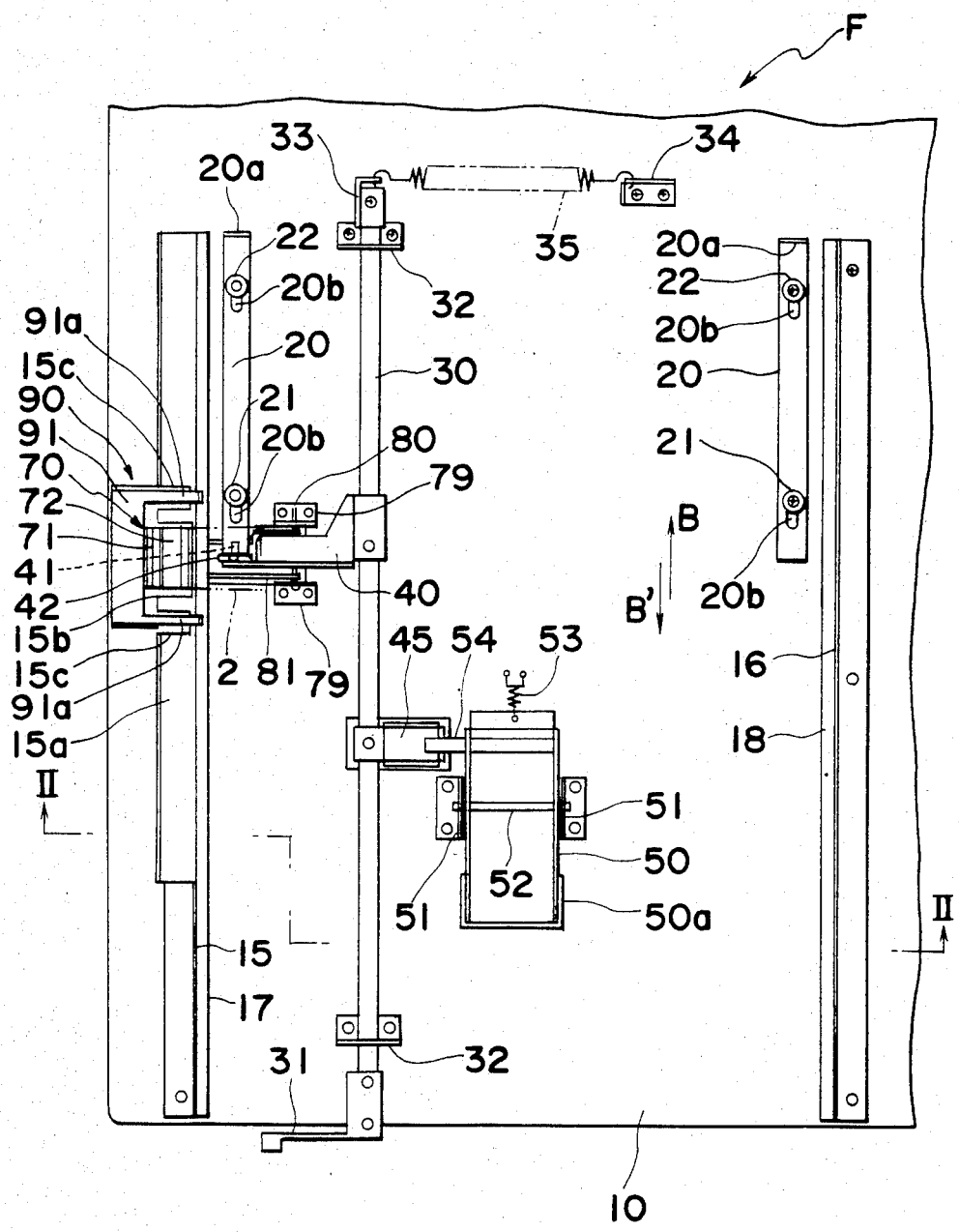
FIG. 1 is a fragmentary top plan view of a paper sheet feeding section for a paper sheet feeding arrangement according to one preferred embodiment of the present invention.

Before the description of the present invention proceeds, it is to be noted that like parts are designated by like reference numerals throughout the accompanying drawings.

Figure 2:
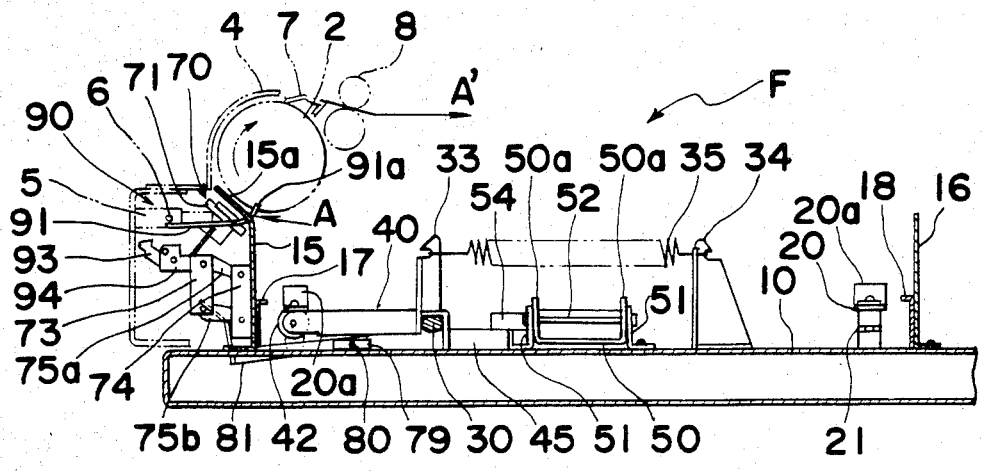
FIG. 2 is a side sectional view taken along the line II—II of FIG. 1.
Figure 3:
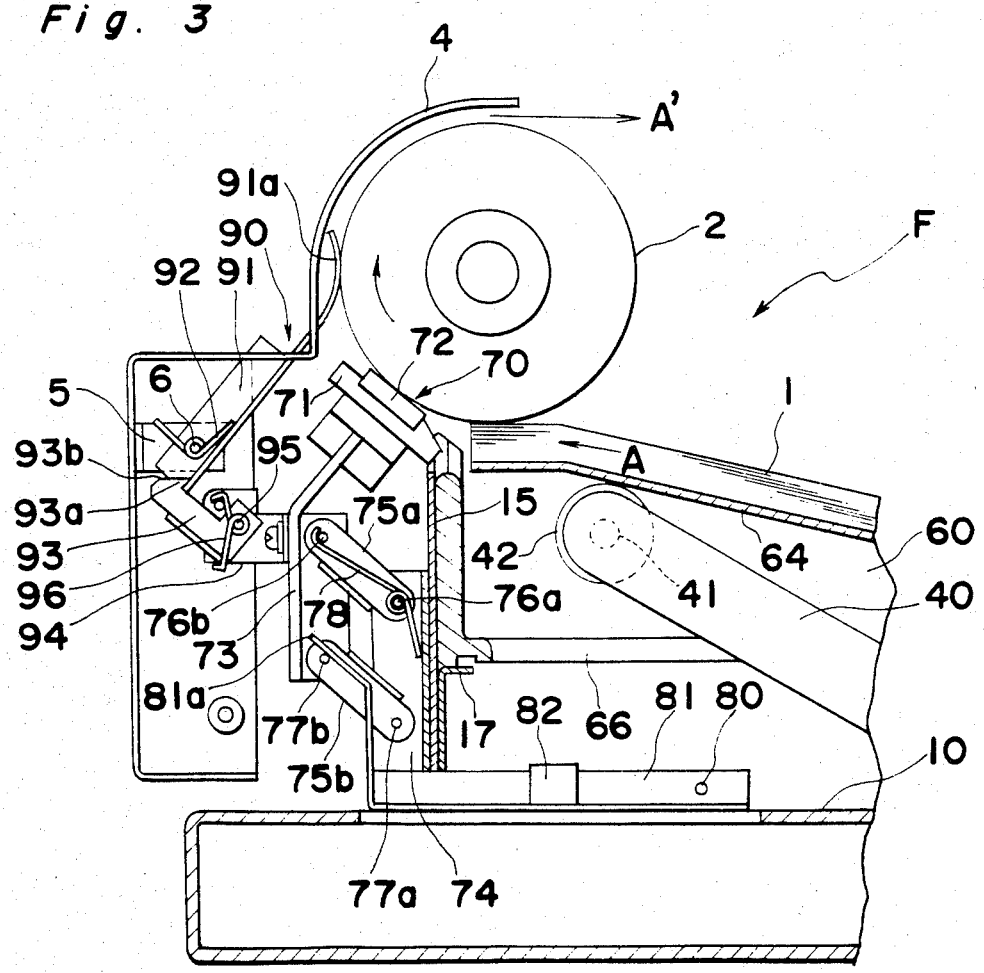
FIG. 3 is a fragmentary side sectional view showing, on an enlarged scale, a main portion in FIG. 2 which is in a state capable of feeding paper sheets.

Referring now to the drawings, there is shown in FIGS. 1 through 3 a paper sheet feeding arrangement according to one preferred embodiment of the present invention as applied to an electrophotographic copying apparatus, which includes a paper sheet feeding section F, a paper sheet cassette 60 accommodating therein copy paper sheets 1 in a stack and detachably mounted in the paper sheet feeding section F, a roller 2 for feeding the copy paper sheets accommodated in said paper sheet cassette 60, one sheet by one sheet, from the uppermost layer of the stack thereof, and a multi-sheet feeding prevention mechanism 70 for the copy paper sheets 1. The paper sheet feeding arrangement further includes a mechanism 90 for pushing back the copy paper sheet projecting at its leading edge from an end face of the cassette 60 in a direction of feeding the copy paper sheet, back into the cassette 60 in association with a paper sheet cassette releasing function during withdrawal of said cassette 60 from the paper sheet feeding section.

The outline of the paper sheet feeding arrangement of FIGS. 1 through 3 is such that the paper sheet or copy paper sheet 1 is fed in the direction of an arrow A and then, reversed in its direction on the outer peripheral surface of the paper feeding roller 2 so as to be transported in the direction of an arrow A' toward a transfer section (not particularly shown). The cassette 60 is mounted or attached in the direction indicated by an arrow B, and withdrawn or detached in the direction shown by an arrow B' (FIG. 1). In other words, there is adopted the cassette attaching and detaching system in the direction intersecting at right angles with the paper feeding direction. For the multi-sheet feeding prevention mechanism 70, there is employed a paper sheet separating stand system in which a paper sheet separating stand 71 is arranged to contact the lower peripheral portion of the paper feeding roller 2, while a lever system having a pushing lever 91 is adopted for the paper sheet pushing mechanism 90.

Figure 4:
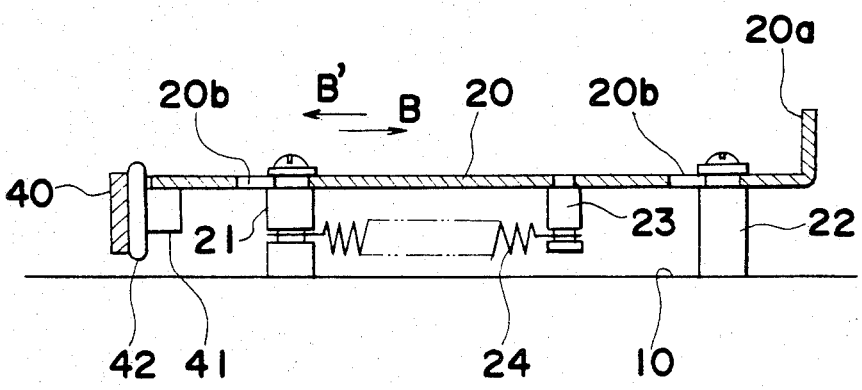
FIGS. 4 and 5, are fragmentary cross sections showing, on a still enlarged scale, essential portions of the arrangement illustrated in FIGS. 1 to 3.

More specifically, in the paper sheet feeding section F, cassette end portion guide plates 15 and 16, and bottom portion guide plates 17 and 18 are respectively mounted in spaced relation from each other on a base 10 so as to be directed in the directions B and B' for detaching and attaching the paper sheet cassette 60, while an upper piece 15*a* (FIGS. 1 and 2) projecting upwardly from the end portion guide plate 15 is located adjacent to the lower peripheral portion of the paper feeding roller 2 so as to extend along the rotational direction of the roller 2 (i.e. in the clockwise direction in FIG. 2) for functioning as a guide plate for the copy paper sheet 1. Moreover, on the base 10, there are provided a pair of spaced cassette positioning plates 20 along the directions B and B' for attaching and detaching the cassette 60. As shown in FIG. 4, each of the positioning plates 20 has a bent portion or projection 20*a* at its one end, and is formed with elongated openings 20*b* which are slidably engaged with corresponding pins 21 and 22 fixed on the base 10 so as to be movable in the directions B and B' within the range of said elongated openings 20*b*. Meanwhile, a tension spring 24 is stretched between the pin 21 and a pin 23 projecting downwardly from the rear surface of the positioning plate 20 for normally urging each of the positioning plates 20 in the cassette detaching direction B'.

On the base 10, there is further provided a shaft 30 (FIG. 1) extended along the cassette attaching and detaching directions B and B', and rotatably supported by a pair of spaced bearings 32 mounted on the base 10, with a releasing lever 31 being fixed to one end of the shaft 30 at the front side of a copying apparatus (not particularly shown). The above shaft 30 is normally urged clockwise by a tension spring 35 stretched between a bracket 33 secured to the other end of the shaft 30 and another bracket 34 fixed on the base 10.

Furthermore, a spring-up lever 40 and a cassette releasing lever 45 are also fixed adjacent to the central portion of the shaft 30. The spring-up lever 40 has a pin 41 (FIGS. 1, 3 and 4) and a roller 42 at its forward end, and as shown in FIG. 4, in the state where the cassette 60 is detached, the pin 41 contacts the end portion of the positioning plate 20 from below, and by the above contact, the rotation of the shaft 30 by the tension spring 35 is to be restricted.

Figure 5:
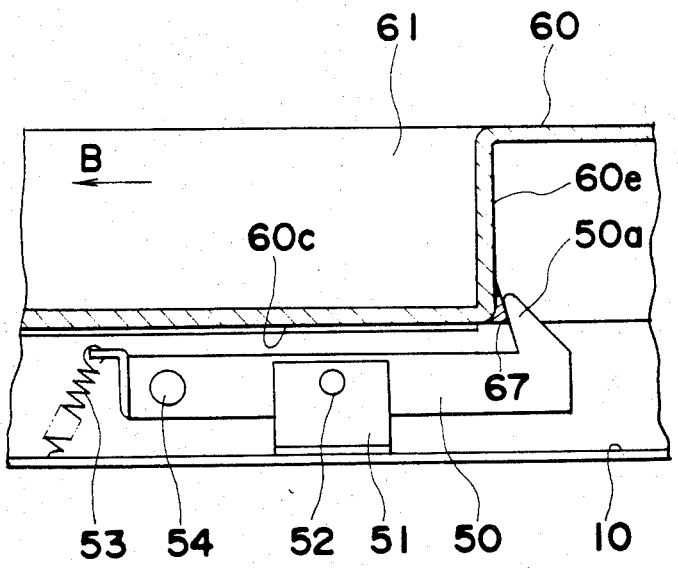

Referring also to FIG. 5, there is further provided a cassette stopper 50 having a projection 50*a* formed at its one end for engagement with a corresponding projection 67 provided on a rear side wall 60*e* of the cassette 60, and pivotally supported on bearings 51 mounted on the base 10 through a shaft 52. The cassette stopper 50 is normally urged in the counterclockwise direction by a tension spring 53 connected between the other end thereof and the base 10, and the above urging force is restricted through contact of a pin 54 fixed adjacent to the other end of said cassette stopper 50, with the cassette releasing lever 45 as described earlier from the above.

Figure 6:
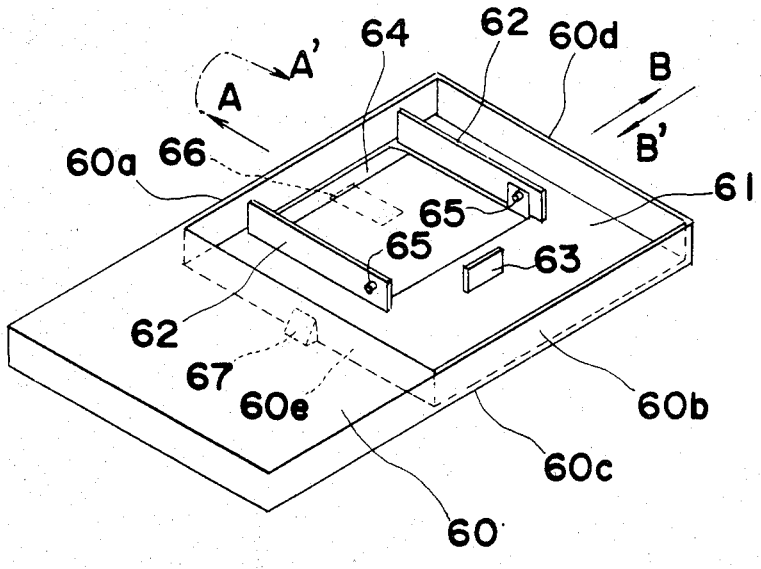
FIG. 6 is a perspective view of a paper sheet cassette which may be employed in the arrangement of FIGS. 1 to 3.

Referring further to FIG. 6, the cassette 60 to be employed in the above embodiment according to the present invention is generally of a rectangular box-like configuration having front and back walls, side walls, and a bottom wall, and includes a sheet paper storing recess 61 defined by the front wall 60*d*, rear wall 60*e*, side walls 60*a* and 60*b* and bottom wall 60*c*, and a pair of spaced paper sheet side edge restricting plates 62 and a paper sheet rear edge restricting plate 63 which are provided in said paper sheet storing recess 61, with a spring-up plate 64 being pivotally mounted at corresponding side edges thereof on the restricting plates 62 by pins 65. The copy paper sheets 1 are positioned by the above restricting plates 62 and 63, and mounted in a stack on the spring-up plate 64. The attaching and detaching functions for the cassette 60 will be described later.

Referring back to FIG. 3, the multi-sheet feeding prevention mechanism 70 includes a fixing plate 73, and a paper sheet separating stand 71 having a friction member 72 and mounted at the forward end of the fixing plate 73, with the fixing plate 73 being mounted at its base portion to a bracket 74 secured to the guide plate 15 described earlier through levers 75*a* and 75*b*, which are pivotally connected to the bracket 74 and the fixing plate 73 by pins 76*a* and 77*a*, and 76*b* and 77*b* respectively as shown. More specifically, the levers 75*a* and 75*b* are pivotable about the pins 76*a* and 77*a*, and based on the above pivotal movement, the fixing plate 73 and the paper sheet separating stand 71 carry out functionings resembling the pivotal movement generally in vertical directions. One end of a torsion spring 78 wound around the pin 76*a* contacts the pin 76*b* under pressure from below, and by the spring force applied thereby, the friction member 72 lightly contacts the lower peripheral portion of the paper feeding roller 2. Meanwhile, the forward end portion 81*a* of a releasing plate 81 pivotally mounted through a pin 80 on bearings 79 secured to the base 10 is extended so that it may contact the pin 77*b* from the above. When the roller 42 of the spring-up lever 40 described earlier is moved downwardly, it is brought into contact with a pin 82 provided on the releasing plate 81, and upon contact of the roller 42 with the pin 82, the releasing plate 81 is rotated counterclockwise about the pin 80, with its end portion 81*a* depressing the pin 77*b*, whereby the fixing plate 73 and paper sheet separating stand 71 are moved downwardly against the spring force of the torsion spring 78 so as to release the friction member 72 from contact with respect to the paper feeding roller 70.

On the other hand, the sheet pushing back mechanism 90 includes a pushing lever 91 pivotally mounted through a pin 6 on a bracket 5 fixed to a frame (not shown), with bifurcated forward end portions 91*a* of the pushing lever 91 being located at the opposite sides of the paper feeding roller 2 as shown in FIG. 1. The pushing lever 91 is normally urged clockwise by a torsion spring 92 wound around the pin 6, and the urging force is restricted by a lever stopper 93. The lever stopper 93 formed with a claw portion 93*a* having an inclined portion 93*b* is pivotally mounted through a pin 95 on a bracket 94 fixed to the fixing plate 73 described earlier so as to be normally urged clockwise by a torsion spring 96 wound around the pin 95, and is restricted against rotation in the clockwise direction in a position shown in FIG. 3 by the contact of a projection for retaining (not shown) with the bracket 94. More specifically, the lever stopper 93 is arranged to be vertically movable together with the fixing plate 73 and the paper sheet separating stand 71, and upon upward movement, the claw portion 93*a* thereof engages the rear end of the pushing lever 91 so as to retain said lever 91 at a position where the bifurcated end portions 91*a* thereof are retreated from the opposite sides of the paper feeding roller 2.

By the downward movement of the lever stopper 93 together with the fixing plate 73, the engagement of the claw portion 93*a* of the stopper 93 with the rear end portion of the pushing lever 91 is released, and the pushing lever 91 is rotated by the spring force of the torsion spring 92 up to the position as shown in FIG. 2. In the above case, the forward end portion 91*a* of the pushing lever 91 pushes the copy paper sheet 1 located between the paper feeding roller 2 and the paper sheet separating stand 71, back into the cassette 60 as described in detail hereinafter. Subsequently, when the paper feeding is restarted, the stopper 93 has been moved upwardly together with the fixing plate 73 and paper sheet seperating stand 71, etc. for standing-by in a state as shown in FIG. 3, and upon feeding out of the copy paper sheet 1 through rotation of the paper feeding roller 2, the pushing lever 91 is gradually pushed up by the leading edge of the sheet 1 so as to be rotated in the counterclockwise direction against the spring force of the torsion spring 92, and thus, the claw portion 93*a* of the lever stopper 93 engages the rear end of the pushing lever 91.

It is to be noted here that, in the upper piece 15*a* of the guide plate 15 described earlier, there are formed a notch 15*b* for positioning the paper sheet separating stand 71, and another pair of notches 15*c* for allowing the forward end portions 91*a* of the pushing lever 91 to pivot, so that, when the pushing lever 91 is rotated in the clockwise direction as shown in FIG. 2, such rotation is restricted by the contact of the forward end portions 91*a* of the pushing lever 91 with inner portions of the notches 15*c*.

Subsequently, functions of the paper sheet feeding arrangement as described so far will be explained together with functions for attaching and detaching the cassette with respect to said paper sheet feeding arrangement.

In the first place, for mounting the paper sheet cassette 60 onto the paper sheet feeding arrangement, the cassette 60 is inserted onto the base 10 in the direction of the arrow B from the lower side in FIG. 1. In the above case, the side walls 60*a* and 60*b* of the cassette 60 are guided by the guide plates 15 and 16 on the base 10, while the bottom wall 60*c* thereof is guide by the guide plates 17 and 18. Immediately before completion of insertion of the cassette 60, the end face 60*d* thereof contacts the projections 20*a* of the positioning plates 20 so as to move the plates 20 in the direction of the arrow B against the urging force of the tension springs 24. Meanwhile, during passing of the bottom wall 60*c* of the cassette 60, the stopper 50 is held in a state where it is slightly pivoted clockwise in FIG. 5, with the projection 50*a* of the stopper 50 being depressed by the bottom wall 60*c*, while after passing of said bottom wall 60*c*, the stopper 50 is pivoted counterclockwise by the spring force of the tension spring 53, with the projection 50*a* of the stopper 50 engaging the projection 67 of the cassette 60. In other words, the cassette 60 is locked by the stopper 50, while being subjected to the urging force by the tension spring 24 in the direction of the arrow B′ through the positioning plates 20, and thus, mounted on the base 10 in the state as it is positioned thereon.

Furthermore, following movement of the positioning plates 20 in the direction indicated by the arrow B, the pin 41 of the spring up lever 40 is released from the contact therewith, and the shaft 30, spring-up lever 40 and cassette releasing lever 45 are rotated in the clockwise direction by the spring force of the tension spring 35. In the above case, the forward end portion of the spring-up lever 40 enters the recess 61 through an opening 66 formed in the bottom wall 60*c* of the cassette 60, and the roller 42 pushes up the spring-up plate 64, which is thus pivoted upwardly about the pin 65, and the leading edge of the copy paper sheet 1 is brought into pressure contact with the lower peripheral portion of the paper feeding roller 2 (FIG. 3). Meanwhile, in the multi-sheet feeding prevention mechanism 70, since the releasing plate 81 is released from the depressing force of the roller 42, the fixing plate 73 and sheet separating stand 71 are moved upwardly by the spring force of the torsion spring 78, with the friction member 72 lightly contacting the lower peripheral portion of the paper feeding roller 2. In this state, the pushing lever 91 of the sheet paper pushing back mechanism 90 is still in the approximately horizontal position as shown in FIG. 2.

In the state as described above, upon emission of a paper feeding signal, the paper feeding roller 2 rotates in the clockwise direction in FIG. 3, with the copy paper sheet 1 on the uppermost layer in the stack of the copy paper sheets being fed in the direction of the arrow A. The copy paper sheet 1 is subsequently guided by the guide plate 4 over the outer peripheral surface of the paper feeding roller 2, while pushing up the forward end portion 91*a* of the pushing lever 91, and, after having been separated from the surface of the paper feeding roller 2 by a separating member 7 as shown in FIG. 2, is further transported in the direction indicated by the arrow A′ through a set of rollers 8. After passing of the copy paper sheet 1, the pushing lever 91 is stopped, at its rear end, by the claw portion 93*a* of the stopper 93 in the state as shown in FIG. 3. In this case, not only the first copy paper sheet 1 at the uppermost layer, but also a second copy paper sheet 1 therebelow is also subjected to the rotational force of the paper feeding roller 2 so as to be simultaneously moved from the cassette 60 in the direction of the arrow A, but such a second sheet is prevented from displacement by the contact, at its leading edge, with the friction member 72, and stopped between the paper feeding roller 2 and the sheet separating stand 71.

On the other hand, for withdrawal of the cassette 60, the releasing lever 31 is first rotated in the counterclockwise direction. Such rotation is effected through manual operation, and the spring-up lever 40 and releasing lever 45 are rotated together with the shaft 30 in the counterclockwise direction against the spring force of the tension spring 35. By the pivotal movement of the spring-up lever 40, the spring-up plate 64 in the cassette 60 is released from the pushing up force by the roller 42 and is rotated downwardly by its weight. Simultaneously, the releasing plate 81 having its pin 82 depressed by the roller 42 is pivoted downwardly about the pin 80, and by the depression of the pin 77*b* by the forward end portion 81*a* of the plate 81, the fixing plate 73 is moved downward together with the paper sheet separating stand 71 against the spring force of the torsion spring 78, and thus, the friction member 72 is spaced from the paper feeding roller 2. Moreover, the lever stopper 93 is also moved downwardly corresponding to the above downward movement, and upon disengagement of the claw portion 93*a* from the rear end of the pushing lever 91, said pushing lever 91 is rotated about the pin 6 in the clockwise direction by the spring force of the torsion spring 92 (FIG. 2). In the above case, the forward end portion 91*a* of the pushing lever 91 is brought into contact with the leading edge of the copy paper sheet 1 remaining between the paper feeding roller 2 and the sheet separating stand 71, and this copy paper sheet 1 is urged in the direction opposite to that of the arrow A so as to be pushed back into the cassette 60.

Moreover, the pin 54 of the stopper 50 is raised by the counterclockwise rotation of the releasing lever 45, and the stopper 50 is pivoted about the shaft 52 in the clockwise direction against the spring force of the tension spring 53 (FIG. 5). In this case, the projection 50*a* of the stopper 50 is released from the engagement with the projection 67 of the cassette 60, i.e. the cassette 60 is released from locking, and thus, the cassette 60 is pushed out to a certain extent in the direction of the arrow A′ by the positioning plates 20 through the spring force of the tension spring 24.

In the above state, the operator (not shown) releases the releasing lever 31 from the biasing, and draws out the cassette 60 in the direction of the arrow B′. Upon releasing of the urging force with respect to the releasing lever 31, the shaft 30 again obtains the rotational force in the clockwise direction by the spring force of the tension spring 35, but as shown in FIG. 4, since the shaft 30 is restricted for rotation by the contact of the pin 41 of the spring-up lever 40 with the end portion of the positioning plate 20 which has already returned in the direction of the arrow B′, all the members are restored back to the initial state.

More specifically, according to the present embodiment, in association with the lock releasing function (i.e. operation of the releasing lever 31) with respect to the cassette 60, the pushing lever 91 functions to push the copy paper sheet 1 having the leading edge thereof projecting from the edge face 60*a* of the cassette 60 in the paper feeding direction, back into said cassette 60, thereby to prevent wrinkling, bending, etc. of the copy paper sheet 1 during withdrawal of the cassette 60. In the above case, the lock releasing function is specifically affected through rotation of the stopper 50 associated with the releasing lever 45, and during the above releasing, the cassette 60 is pushed out to a certain extent by the positioning plates 20 (tension springs 24). Accordingly, for positively effecting the pushing back of the copy paper sheet 1 by the pushing lever 91, it is necessary to effect the functioning of the pushing lever 91 sooner than the pushing out movement of the cassette 60, i.e. the functioning of the stopper 50. In the present embodiment, the timing at which the projection 50*a* of the stopper 50 is fully disengaged from the projection 67 of the cassette 60 is set at a time point immediately after pushing back of the copy paper sheet 1 by the forward end portion 91*a* of the pushing lever 91.

Moreover, in the present embodiment, the guide plate 4 is provided in the vicinity of the paper feeding roller 2 along the outer peripheral surface thereof so as to turn back the copy paper sheet 1 in a U-shape, by which arrangement, the radius for turning back the copy paper sheet 1 may be reduced, with a consequent compact size of the paper sheet feeding arrangement on the whole.

As is clear from the foregoing description, in the paper sheet feeding arrangement according to the present invention, there is provided the mechanism for pushing the copy paper sheet projecting at its leading edge from the end face of the cassette in the paper sheet feeding direction, back into the cassette in association with the cassette releasing function during withdrawal of the cassette from the paper feeding section, and therefore, such an inconvenience that the leading edge of the copy paper sheet is projecting from the cassette in the withdrawal of the cassette has been fully eliminated, with the formation of wrinkles, bending, etc. at the leading edge of the copy paper sheet as in the conventional arrangements being advantageously prevented in advance.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. In a paper sheet feeding arrangement for feeding paper sheets, one sheet by one sheet, from a stack of the paper sheets, which comprises a paper feeding roller contacting the paper sheet and driven for rotation in a paper sheet feeding direction and a paper sheet separating member held in pressure contact by said paper feeding roller for preventing the paper sheet fed by said paper feeding roller from advancing so as to feed only the paper sheet contacting the paper feeding roller by passing between said paper feeding roller and said paper sheet separating member, the improvement comprising;

(a) means for holding the stack of paper sheets movably in a direction approximately at right angles with respect to the feeding direction of the paper sheets between a first position where the stack of paper sheets confronts said paper feeding roller and a second position where the stack of paper sheets is spaced from said paper feeding roller, (b) a pushing member pivotally provided so as to be capable of pushing back the paper sheet located between the paper feeding roller and the paper sheet separating member towards the stack of paper sheets through pivotal movement thereof, (c) a first biasing means for urging said pushing member to be pivoted in a direction of the pushing back, (d) a stopper means for stopping said pushing member at a stand-by position for the pushing back against the urging force of said first-biasing means, (e) a second biasing means for urging the holding means in a direction towards said second position when said holding means is in said first position, (f) a locking means for locking said holding means at said first position against the urging force of said second biasing means, (g) a lock releasing means for releasing said locking means from the locked state, and (h) an associating means which is associated with said lock releasing means so as to release said paper sheet separating member from the pressure contact with respect to said paper sheet feeding roller, and also to release said stopper means from stopping said pushing member, said associating means functioning to associate said paper sheet separating member, said stopper means and said locking means with each other so as to effect the releasing in such order as the releasing of the pressure contact of said paper sheet separating member, releasing of stopping of the pushing member by said stopper means, and releasing of locking of said holding means by said locking means following the functioning of said lock releasing means.

2. A paper sheet feeding arrangement as claimed in claim 1, wherein said pushing member, when released from the stopping, stops at a position to block a path of the paper sheet fed out by said paper feeding roller so as to be pushed by the paper sheet fed out, up to the stand-by position to be stopped by said stopper means.

3. A paper sheet feeding arrangement as claimed in claim 1, further including a paper sheet stack depressing means for moving the stack of paper sheets in a direction to be pressed against said paper feeding roller, the depressing function of said paper sheet stack depressing means being removed following functioning of said lock releasing means.

4. A paper sheet feeding arrangement as claimed in claim 2, further including a paper sheet stack depressing means for moving the stack of paper sheets in a direction to be pressed against said paper feeding roller, the depressing function of said paper sheet stack depressing means being removed following functioning of said lock releasing means.

5. A paper sheet feeding arrangement as claimed in claim 1, wherein the paper sheet to be fed out by said paper feeding roller is fed into between said paper feeding roller and a curved guide plate provided along a peripheral surface of said paper feeding roller so as to be fed out in a state where it is generally turned over in its front and reverse faces.

6. A paper sheet feeding arrangement as claimed in claim 2, wherein the paper sheet to be fed out by said paper feeding roller is fed into between said paper feeding roller and a curved guide plate provided along a peripheral surface of said paper feeding roller so as to be fed out in a state where it is generally turned over in its front and reverse faces.

* * * * *